US011883868B2

(12) United States Patent
Seidel et al.

(10) Patent No.: US 11,883,868 B2
(45) Date of Patent: Jan. 30, 2024

(54) METHOD FOR PRODUCING A METAL ARTICLE

(71) Applicant: SMS group GmbH, Düsseldorf (DE)

(72) Inventors: Jürgen Seidel, Kreuztal (DE); Ralf Setzer, Hilchenbach (DE)

(73) Assignee: SMS GROUP GMBH, Düsseldorf (DE)

( * ) Notice: Subject to any disclaimer, the term of this patent is extended or adjusted under 35 U.S.C. 154(b) by 400 days.

(21) Appl. No.: 17/273,443

(22) PCT Filed: Sep. 11, 2019

(86) PCT No.: PCT/EP2019/074215
§ 371 (c)(1),
(2) Date: Mar. 4, 2021

(87) PCT Pub. No.: WO2020/053268
PCT Pub. Date: Mar. 19, 2020

(65) Prior Publication Data

US 2021/0346928 A1 Nov. 11, 2021

(30) Foreign Application Priority Data

Sep. 12, 2018 (DE) ..... 10 2018 215 492.9

(51) Int. Cl.
*B21B 45/08* (2006.01)
*B21B 38/00* (2006.01)

(52) U.S. Cl.
CPC ..... *B21B 45/08* (2013.01); *B21B 2038/004* (2013.01)

(58) Field of Classification Search
CPC ..... B21B 45/04; B21B 45/06; B21B 45/08; B21B 2038/004
USPC ..... 72/39
See application file for complete search history.

(56) References Cited

U.S. PATENT DOCUMENTS

2004/0069034 A1* 4/2004 Seidel ..... B21B 37/74 72/39

FOREIGN PATENT DOCUMENTS

| | | | |
|---|---|---|---|
| DE | 102016217560 | A1 | 9/2017 |
| EP | 1 034 857 | B1 | 12/2003 |
| EP | 1 365 870 | B1 | 10/2004 |
| JP | S57142702 | A | 9/1982 |
| JP | S61111701 | A | 5/1986 |
| JP | H01-205810 | A | 8/1989 |

(Continued)

OTHER PUBLICATIONS

Office Action dated Jun. 1, 2022 in corresponding Japanese Application No. 2021-513802; 12 pages.

(Continued)

*Primary Examiner* — Jimmy T Nguyen
*Assistant Examiner* — Smith Oberto Bapthelus
(74) *Attorney, Agent, or Firm* — Maier & Maier, PLLC

(57) ABSTRACT

A method for producing a metal article, in particular a slab, a pre-strip, a strip, or a sheet, in which the article is first conveyed in the conveying direction through a scale washer and then through a rolling mill, wherein the rolling mill has at least one roll stand, in particular a first roll stand in the conveying direction. The article is subjected in the scale washer to at least one upper row of nozzles, which descales the upper side of the article, and to at least one lower row of nozzles, which descales the lower side of the article.

20 Claims, 2 Drawing Sheets

(56) References Cited

FOREIGN PATENT DOCUMENTS

| | | | |
|---|---|---|---|
| JP | H6-79337 | A | 3/1994 |
| JP | H10-272511 | A | 10/1998 |
| JP | H11-78312 | A | 3/1999 |
| JP | 2001/9520 | A | 1/2001 |
| JP | 2001/47122 | A | 2/2001 |
| KR | 1020040012083 | A | 2/2004 |
| WO | 02070157 | A1 | 9/2002 |

OTHER PUBLICATIONS

International Search Report (with English translation) and Written Opinion (with Machine translation) dated Jan. 15, 2020 in corresponding International Application No. PCT/EP2019/074215; 16 pages.

* cited by examiner

METHOD FOR PRODUCING A METAL ARTICLE

FIELD

The invention relates to a method for producing a metal article, in particular a slab, a pre-strip, a strip, or a sheet, in which the article is first conveyed in the conveying direction through a scale washer and then through a rolling mill, wherein the rolling mill has at least one roll stand, in particular a first roll stand in the conveying direction, wherein the article is subjected in the scale washer to at least one upper row of nozzles, which descales the upper side of the article, and to at least one lower row of nozzles, which descales the lower side of the article.

BACKGROUND

In the rolling mill, the article is usually passed through a number of roll stands; however, it is also possible to use a single roll stand, specifically in the case of a Steckel rolling mill.

In the production of metallic strips, increasing demands are placed on strip temperature control, on the scale properties, and thus on article quality and strip running stability. Investigations have shown that not only the temperature control but above all the scale growth following a scale washer has an influence on the above properties for the following rolling processes. It has been shown that, above all, a different scale layer thickness on the upper and lower side of the strip results in thrust rolling effects, ski formation, and rolling torque trimming during rolling forming and different roll roughness as well as in the later course of the rolling program in different strip roughness and disadvantageous secondary scale effects on the upper and lower side.

It is known that descaling devices are used in the operation of hot rolling mills. After the scale has been removed with the aid of a high-pressure water jet, a secondary scale layer immediately forms again during further transport. The rate of growth of the scale thickness depends on the plant and process conditions. On the upper side the strip or the slab is wetted by water in the area of the scale washer or the water remains there, on the lower side the applied water falls directly back down. When passing through the scale washer section, therefore, there are usually different strip temperatures on the upper and lower sides. As a consequence, these result in different thicknesses of the scale layer.

EP 1 365 870 B1 already describes how the conditions can be improved by setting a symmetrical temperature distribution from the upper to the lower side of the strip in the region of the scale washer and after the scale washer. However, these measures are not sufficient to be able to set optimal conditions for the rolling mill and the strip. Rather, the scale formation behavior has to be taken into consideration and deliberately influenced.

Further and different solutions are shown in EP 1 034 857 B1, JP 1-205810 A, JP 2001-9520 A, and JP 2001-47122 A.

SUMMARY

The invention is based on the object of refining a method of the generic type in such a way that the disadvantages mentioned can be reduced. Accordingly, the intention is to improve the article and system properties by optimizing the scale washer or the process of descaling in the same. This is intended to be able to influence the formation of secondary scale in particular.

The achievement of this object by the invention is characterized in that the method comprises the following steps:

a) determining the thickness of a secondary scale layer on the upper side of the article which is present at the location of the at least one roll stand, in particular at the location of the first roll stand, or at a defined location in front of the at least one roll stand, in particular in front of the first roll stand, and determining the thickness of a secondary scale layer on the lower side of the article which is present at the location of the at least one roll stand, in particular at the location of the first roll stand, or at the defined location in front of the at least one roll stand, in particular the first roll stand;

b) defining the distance between the last upper row of nozzles in the conveying direction and the last lower row of nozzles in the conveying direction, so that the difference between the thickness of the secondary scale layer on the upper side of the article and the thickness of the secondary scale layer on the lower side of the article is below a specified value at the above location.

The defining in accordance with step b) above is preferably carried out in such a way that a defined article mix is considered for the article and a mean distance is determined for this.

The thickness of the upper and lower secondary scale layer can be determined by a measurement at the location of the at least one roll stand, in particular at the location of the first roll stand, or at the defined location in front of the at least one roll stand, in particular in front of the first roll stand (this defined location can be one just before the first roll stand that is selected or defined for the purpose of determining the thickness of the secondary scale layer).

However, it is also possible to determine the thickness of the upper and lower secondary scale layer by numerical simulation by means of a process model. In this case, it can be provided that the numerical simulation comprises the calculation of the temperature profile on the upper side and on the lower side of the material as it passes through the scale washer to the rolling mill. Furthermore, it is advantageously provided that the numerical simulation or calculation of the thickness of the upper and lower secondary scale layers comprises a determination of the thickness by way of the relationship:

$$s=k_P\cdot\sqrt{t}$$

where s: thickness of the secondary scale layer $k_P$: scale coefficient t: oxidation time from the completion of descaling The mentioned equation for determining the scale thickness can be used in a simulation model. The mentioned scale coefficient, which is dependent on temperature and material, can be determined experimentally or taken from the literature. It can also be determined empirically by appropriate studies in a professional manner.

Alternatively, another model can also be used to determine the scale thickness.

The distance between the last upper row of nozzles in the conveying direction and the last lower row of nozzles in the conveying direction is preferably selected to be at least 0.2 m, particularly preferably at least 0.3 m.

Whereas the distance between the last row of nozzles in the conveying direction and the at least one roll stand, in particular the first roll stand, is preferably at most 6.0 m, particularly preferably at most 4.0 m.

The specified value for the difference between the thickness ($s_{upper}$) of the secondary scale layer on the upper side of the article and the thickness ($s_{lower}$) of the secondary scale layer on the lower side of the article when entering the at least one roll stand, in particular the first roll stand, is preferably determined according to the relationship:

$$|(s_{oben}-s_{union})|/s_{Mittel}*100\% \leq 15\%$$

where: $s_{mean}=(s_{upper}+s_{lower})/2$

Preferably, the temperature of the article in the region between the scale washer and the at least one roll stand, in particular the first roll stand, is set so that for the temperature ($T_{upper}$) of the article on the upper side and for the temperature ($T_{lower}$) of the article on the lower side when entering the at least one roll stand, especially the first roll stand, the following applies:

$$|(T_{oben}-T_{union})|/T_{Mittel}*100\% \leq 3\%$$

where: $T_{mean}=(T_{upper}+T_{lower})/2$

The temperatures are to be used in ° C.

The article is preferably additionally cooled using water in the region between the scale washer and the at least one roll stand, in particular the first roll stand.

Different nozzle sizes can be used in the scale washer on the upper side of the article and on the lower side of the article.

Another row of nozzles can be provided in the scale washer for the lower side of the article, which can be activated if necessary.

Finally, one refinement provides that the amount of water and/or the pressure level of the discharged water in at least one of the rows of nozzles on the upper side and/or on the lower side of the article is set individually, in particular reduced, depending on the feed speed of the article into the rolling mill and/or the material of the article.

The proposed concept provides a combination of measures and a definition of boundary conditions, so that instead of symmetrical strip temperatures, a targeted influencing of the scale formation or scale symmetry is possible, which enables an improved procedure in terms of the above stated object.

BRIEF DESCRIPTION OF THE DRAWINGS

Exemplary embodiments of the invention are shown in the drawing. In the figures.

DETAILED DESCRIPTION

Figure 1:
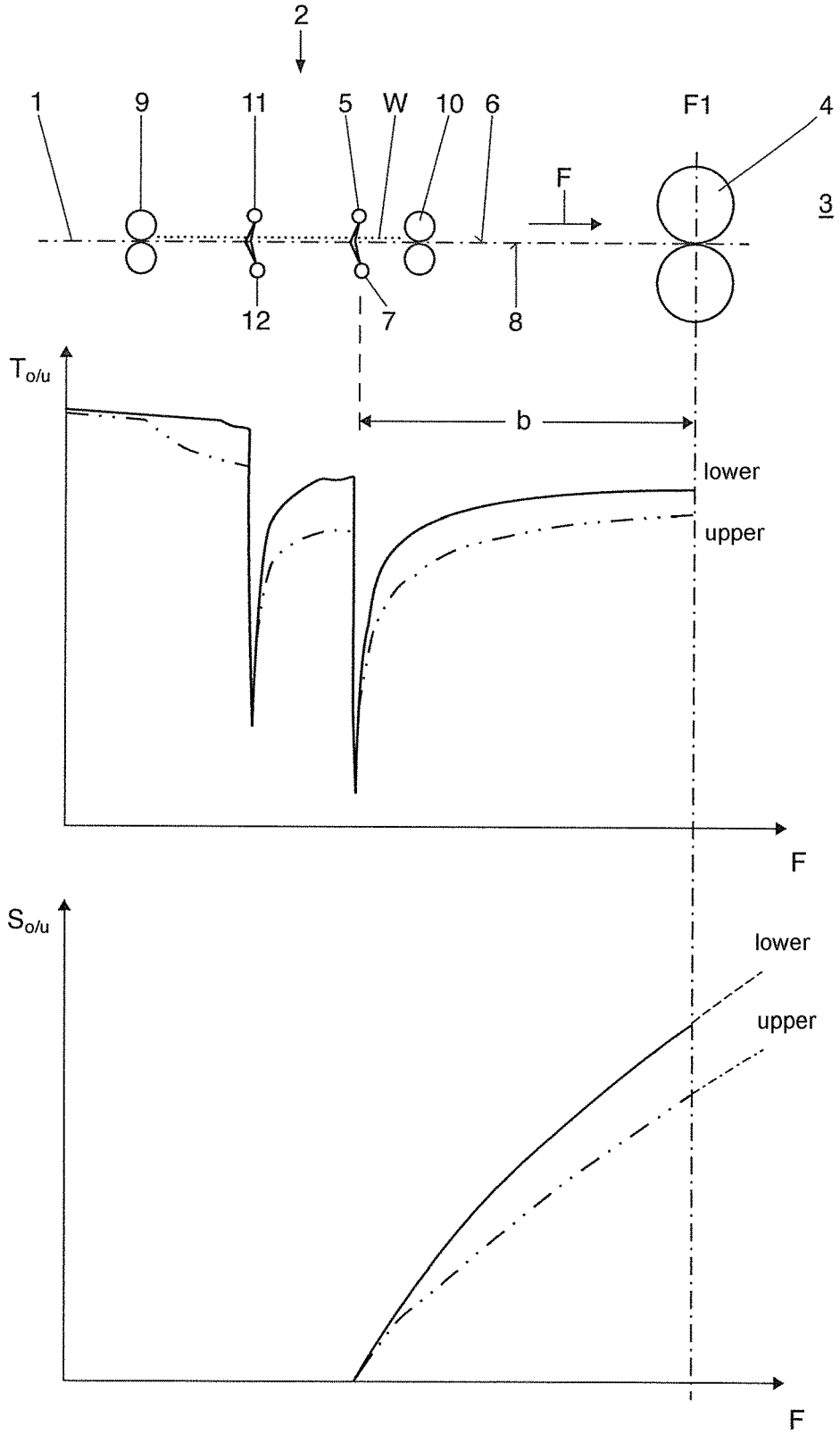
Fig. 1 (PRIOR ART)
FIG. 1 schematically shows a section of a production plant for a metallic strip according to the prior art, wherein the region of a scale washer and a subsequent rolling mill are shown and wherein for the course in the conveying direction, the temperature profile and the formation of secondary scale is shown with a calculated thickness respectively for the upper side and lower side of the strip.

In the figures, a strip 1 (or a slab, a pre-strip, or a sheet) is indicated, which is descaled in a scale washer 2 on the upper side 6 of the strip 1 and on the lower side 8 of the strip 1. The strip cleaned or descaled in this way is fed in a conveying direction F to a rolling mill 3, where it is rolled. In the present exemplary embodiment, the rolling mill 3 has a number of roll stands 4, only one of which is shown in the figures, namely the first roll stand F1 of the rolling mill 3.

The scale washer 2 has an upper row of nozzles 5 and a lower row of nozzles 7, which are provided for the respective cleaning or descaling of the corresponding side of the strip 1. A pair of rollers 9 and a pair of rollers 10 are provided for conveying the strip. In the exemplary embodiment, the scale washer 2 also has a further upper row of nozzles 11 and a further lower row of nozzles 12. Using the various rows of nozzles, water W is applied to the upper side and the lower side of the strip 1.

FIG. 1 shows as an example a two-row scale washer 2 in front of a rolling mill 3 in the form of a finishing train according to the prior art. It is shown how the strip surface temperatures ($T_{o/u}$) can develop. Particularly noticeable is the scale growth between the respective last scale washer spray bar 5 or 7 and the finishing train 3. If—as shown in FIG. 1—the two descaling rows 5 and 7 are arranged one over the other, with these boundary conditions at equal distance to the first roll stand 4 of the rolling mill 3 (F1) and different surface temperatures $T_{o/u}$, a different scale layer thickness so/u forms, which results in the problems described above. Above all, the differences in the scale layer thickness between the upper and lower sides are disadvantageous and are to be minimized or kept within specific limits according to the invention.

Figure 2:
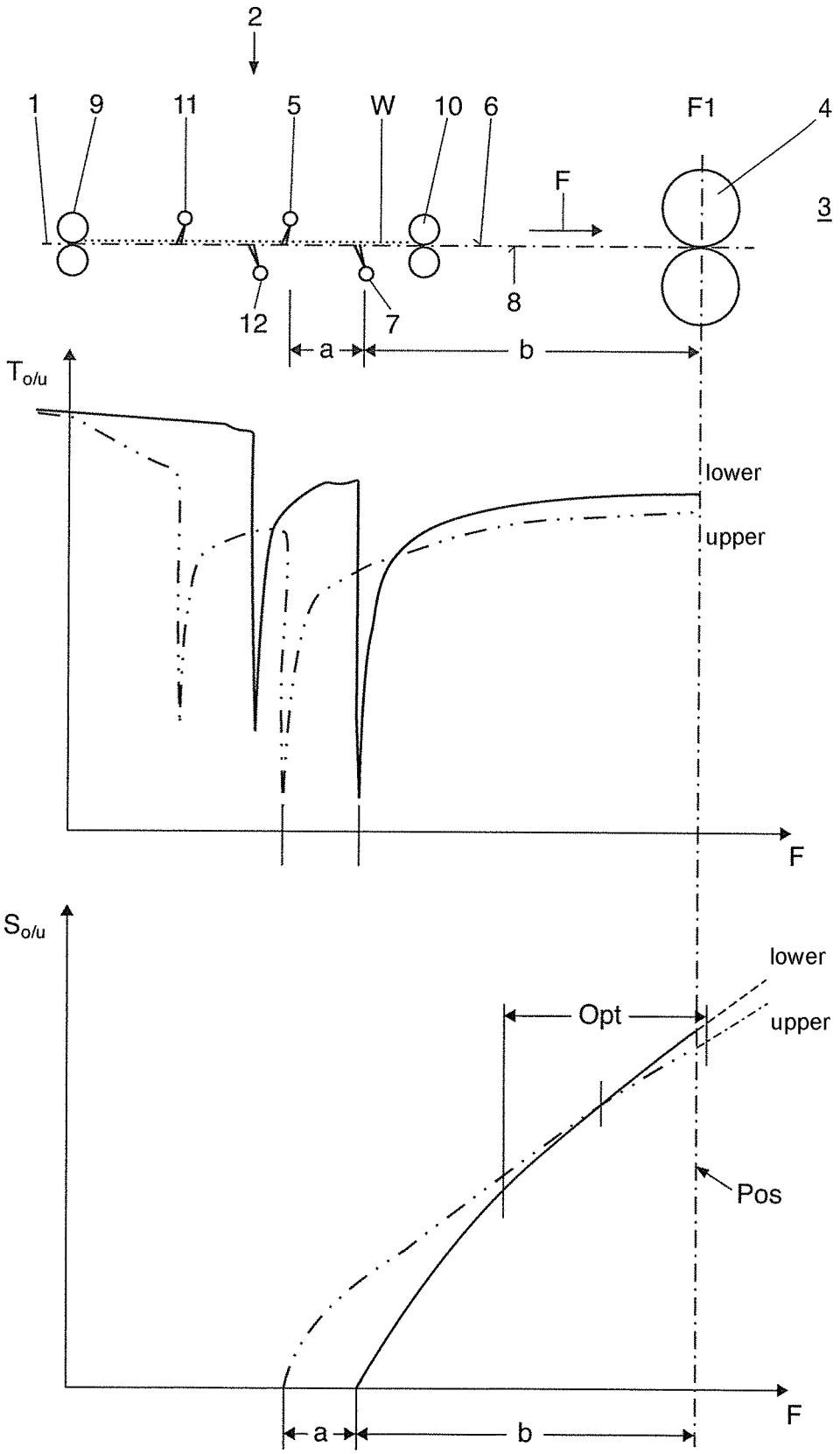
FIG. 2 shows, in the representation according to FIG. 1, the corresponding illustration for a solution according to the invention.

If one wishes to reduce the thickness differences of the scale layer between the upper side 6 of the strip 1 and the lower side 8 of the same or, ideally, to set them equal during the rolling process, thus—as shown in FIG. 2 according to an example according to the invention—the upper descaling row 5 and the lower descaling row 7 can be arranged offset to one another in a defined manner in the conveying direction F, in such a way that the lower row 7 is located closer in front of the finishing train 3 or specifically in front of the first roll stand F1. This is shown by the distance a in FIG. 2. If the rules of scale formation are taken into account in a suitable manner, the scale conditions can be optimized, which is shown below in a specific exemplary embodiment.

The temperature curves for the upper side 6 of the strip 1 ($T_o$) and for the lower side 8 of the strip 1 ($T_u$) as well as the important scale growth with the scale layer thickness forming on the upper side 6 of the strip 1 ($s_o$) and on the lower side 8 of strip 1 ($s_u$) are shown in FIG. 2 and may be calculated. Thus, the distance b between a descaling row and the roll stand F1 and the distance a between the upper and lower descaling rows can be determined in such a way that the scale layer thicknesses are optimal for the following or subsequent rolling deformations. This means that the difference in the scale layer thickness so/u is set so that the difference in the layer thickness on the upper side and the lower side of the strip on the roll stand is less than a specified value.

A process model is used to describe the temperature change within the rolling train—also in the region of the scale washer 2 up to and within the rolling train 3. If the calculated temperature profile is known, the scale growth can be calculated using the following scale model or the following scale equation:

$$s=k_p*(t)^{0.5}$$

where s: scale layer thickness (starts with 0 after the last descaling)

t: oxidation time (begins after the last descaling)

$k_P$: scale coefficient, dependent on the strip surface temperature, the strip material, and the ambient conditions (water, air).

The rolling train 3 is designed in such a way that the following optimal defined conditions are settable for the feed speed and surface temperatures between the scale washer 2 and the rolling train 3, weighted by the article mix and averaged according to the production share:

The upper and lower scale washer spray bars 5 and 7 are arranged offset from one another (distance a) so that the lower spray bar is arranged last. The distance b between the last descaling bar 7 and the roll stand F1 as well as the distance a between the upper and lower spray bars 5 and 7 are chosen so that the scale thickness upon entry into the rolling train (in the example at the stand F1 of the finishing train 3) is on average preferably equal on the upper and lower side of the strip or the difference Δs of the calculated scale layer thicknesses (absolute value) between the upper and lower side is less than 15% of the average scale layer thickness (see the range for the distance of the roll stand F1 from the last descaling row 7 in FIG. 2).

The relationships for the thickness of the secondary scale apply upon entry into the first roll stand F1

$$s_{mean}=(s_{upper}+s_{lower})/2$$

$$\Delta s=|(s_{upper}-s_{lower})|/s_{mean}*100\%,$$

where $s_{mean}$: average scale layer thickness of the upper/lower side of the strip $s_{upper}$: scale layer thickness on the upper side $s_{lower}$: scale layer thickness on the lower side Δs: percentage difference of the calculated scale layer thicknesses For the purpose of further optimization of the scale growth on the upper and lower side and compliance with the above goals for the design and/or for daily use in the event of deviation from the average conditions (feed speed, temperatures), additional high pressure and/or low pressure cooling devices (not shown) are arranged between the scale washer 2 and the rolling train 3, which are activated depending on the results of the process model in order to approach the goal of the most equal possible scale layer thickness on the upper and lower side 6 and 8 of the strip 1 at the location of the roll stand F1 or at a defined reference location immediately in front of the roll stand F1.

Furthermore, the surface temperature profiles behind the scale washer 2 with or without additional strip cooling between the scale washer 2 and the rolling train 3 should result in the surface temperatures such that the temperature difference (absolute value) between the upper and lower side 6 and 8 of the strip 1 is less than 3% of the mean surface temperature at the roll stand.

The following relationships apply:

$$T_{mean}=(T_{upper}+T_{lower})/2$$

$$\Delta T=|(T_{upper}-T_{lower})|/T_{mean}*100\%$$

where $T_{mean}$: average strip temperature of upper/lower side $T_{upper}$: strip temperature on the upper side $T_{lower}$: strip temperature on the lower side ΔT: percentage difference of the calculated strip temperatures at the roll stand The temperatures are to be used in ° C.

The following distances preferably result from the calculations for the optimal conditions in the region of the scale washer 2 and the rolling train 3:

The distance a between the upper and lower spray rows 5 and 7 of the scale washer 2 is preferably greater than 0.2 m, particularly preferably greater than 0.3 m.

The distance b between the last scale washer spray row 7 and the following roll stand F1 is preferably less than or equal to 6 m and particularly preferably less than or equal to 4 m.

The following additional measures can be taken as a further control element in order to optimally set the scaling conditions and thus the ratio of the scale layer thicknesses:

The descaling nozzle for the strip upper side differs from the nozzle on the strip lower side; In particular, larger nozzles are used at the bottom than at the top. In this case, this means that a larger amount of water is applied to the lower side in order to be able to influence the temperatures on the surface of the strip in a desired manner.

Optionally, a third row of scale washer nozzles can be provided on the lower side of the strip, which is activated by the process model depending on the boundary conditions.

Depending on the feed speed and the strip material, the first row of descaling nozzles can only be deactivated on top, only on the bottom, or on both sides (this applies to a multi-row scale washer).

Depending on the feed speed and the strip material, the amount of water and/or the pressure level of the first and/or second row of descaling nozzles (or also on a further row of nozzles) can be individually reduced on the upper and/or lower side.

The additional coolers between the scale washer 2 and the rolling train 3 are installed and activated if necessary.

The design of the plant, in particular the determination of the distances in the region scale washer—roll stand, takes place in the following steps:

In a first step, the distance between the last descaling row 7 up to the rolling train, i.e., up to the first roll stand F1, is first determined (distance b). This distance is preferably minimized in order to minimize the formation of secondary scaling.

Then, in a second step, the determination of the distance (a) between the upper and lower scale washer spray bars is established so that the conditions or objectives of the above scale and/or temperature relationships are met or the difference of the scale layer thickness between the upper and lower side is minimal.

If the difference of the scale layer thickness cannot be maintained within the desired range when designing the plant, additional coolers have to be provided between the scale washer 2 and the rolling train 3 and/or the above additional measures have to be carried out.

When operating the existing plant with given distances, the variable temperature or scale control elements (nozzle pressures, amounts of water) are used so that the above tolerances are adhered to.

For the indirect support of the scale model, the surface temperatures can be measured in front of and/or behind the (first) roll stand F1 and compared to the calculated values. The difference in roughness of the work rolls of the roll stand can also be indirectly deduced from the measured torque difference between the upper and lower drive spindles if a difference persists over multiple strips or increases in the course of a rolling program. This measured value can also be used as feedback for the scale model and the setting of the descaling parameters (water pressure and amount).

A process model is preferably provided that not only optimally controls the pressure level or the amount of water in the scale washer and the additional coolers (if present) behind the scale washer, so that one comes as close as possible to the goal of equal scale layer thicknesses on the upper and lower side, but the energy consumption (i.e., minimum water pressure and amount) and strip temperature losses (minimum water amount) can also be minimized. Piston pumps are favorable for varying the pressure level and for saving energy.

The proposed embodiment according to the invention makes it possible to select a position (Pos) for the position of the first roll stand F1, the extent of which is indicated in FIG. 2. This position is within an optimal range (Opt) for the arrangement of the roll stand F1 following the scale washer 2.

In the optimal range (Opt), the required conditions for the ratio of the thicknesses of the secondary scale layers, as required above, are present.

The specified distances are thus advantageously designed according to the rolling portfolio.

In multi-row scale washers, the concept can be adapted so that the descaling rows can be switched on or off as required. The pressure level can be set differently for the upper or lower of the respective rows of nozzles depending on the process.

An additional cooler between the scale washer and the finishing train can be provided and activated if necessary.

LIST OF REFERENCE SIGNS

1 metal article (slab, pre-strip, strip, sheet)
2 scale washer
3 rolling mill
4 mill stand
5 upper row of nozzles
6 upper side of the strip
7 lower row of nozzles
8 lower side of the strip
9 pair of rollers
10 pair of rollers
11 further upper row of nozzles
12 further lower row of nozzles
F conveying direction
F1 first roll stand
a distance (in conveying direction) between the upper and the lower row of nozzles
b distance (in conveying direction) between the last row of nozzles and the first roll stand
$s_{upper}$ thickness of the secondary scale layer on the upper side of the strip
$s_{lower}$ thickness of the secondary scale layer on the lower side of the strip
$T_{upper}$ temperature of the strip on the upper side
$T_{lower}$ temperature of the strip on the lower side
W water
Pos selected position of the first roll stand (F1)
Opt optimal range for the arrangement of the roll stand (F1) following the scale washer

The invention claimed is:

1. A method for producing a metal article selected from a group of a slab, a pre-strip, a strip, or a sheet, in which the metal article is first conveyed in a conveying direction through a scale washer to perform initial descaling of a scale layer and then through a rolling mill, wherein the rolling mill has at least one roll stand, said at least one roll stand including a first roll stand in the conveying direction, wherein the metal article is subjected in the scale washer to at least one upper row of nozzles, which descales an upper side of the metal article, and to at least one lower row of nozzles, which descales a lower side of the metal article, the method comprising the steps of:

a) determining a thickness ($s_{upper}$) of a secondary scale layer on the upper side of the metal article which is present at a location of the first roll stand, or at a defined location in front of the first roll stand, and determining a thickness ($s_{lower}$) of a secondary scale layer on the lower side of the metal article which is present at the location of the first roll stand or at the defined location in front of the first roll stand;

b) defining a distance between a last upper row of nozzles in the conveying direction and a last lower row of nozzles in the conveying direction, so that the difference between the thickness ($s_{upper}$) of the secondary scale layer on the upper side of the metal article and the thickness ($s_{lower}$) of the secondary scale layer on the lower side of the metal article is below a specified value at the above location.

2. The method according to claim 1, wherein the step of defining the distance between the last upper row of nozzles in the conveying direction and the last lower row of nozzles in the conveying direction is to consider a defined article mix for the metal article and determining a mean distance for this purpose.

3. The method according to claim 2, wherein the determination of the thickness ($s_{upper}$) of the upper secondary scale layer and the determination of the thickness ($s_{lower}$) of the lower secondary scale layer is carried out by a measurement at the location of the first roll stand or at the defined location in front of the first roll stand.

4. The method according to claim 2, wherein the determination of the thickness ($s_{upper}$) of the upper secondary scale layer and the determination of the thickness ($s_{lower}$) of the lower secondary scale layer is carried out by numerical simulation using a process model.

5. The method according to claim 2, wherein the distance between the last upper row of nozzles in the conveying direction and the last lower row of nozzles in the conveying direction is selected to be at least 0.2 m.

6. The method according to claim 1, wherein the determination of the thickness ($s_{upper}$) of the upper secondary scale layer and the thickness ($s_{lower}$) of the lower secondary scale layer is carried out by a measurement at the location of the first roll stand, or at the defined location in front of the first roll stand.

7. The method according to claim 6 wherein the distance between the last upper row of nozzles in the conveying direction and the last lower row of nozzles in the conveying direction is selected to be at least 0.2 m.

8. The method according to claim 1, wherein the determination of the thickness ($s_{upper}$) of the upper secondary scale layer and the thickness ($s_{lower}$) of the lower secondary scale layer is carried out by a numerical simulation using a process model.

9. The method according to claim 8, wherein the numerical simulation comprises calculation of a temperature profile on the upper side and on the lower side of the metal article as the metal article passes through the scale washer to the rolling mill.

10. The method according to claim 9, wherein the numerical simulation of the thickness ($s_{upper}$) of the upper secondary scale layer and the thickness ($s_{lower}$) of the lower secondary scale layer comprises a determination of the thickness ($s_{upper}$, $s_{lower}$) the thickness ($s_{upper}$) of the upper secondary scale layer and the thickness ($s_{lower}$) of the lower secondary scale layer by the relationship:

$$s=k_p\cdot\sqrt{t}$$

where s: thickness of the secondary scale layer $k_P$: scale coefficient t: oxidation time from the completion of descaling.

11. The method according to claim 8, wherein the numerical simulation of the thickness ($s_{upper}$) of the upper secondary scale layer and the numerical simulation of the thickness ($s_{lower}$) of the lower secondary scale layer comprises a determination of the thickness ($s_{upper}$) of the upper secondary scale layer and the thickness ($s_{lower}$) of the lower secondary scale layer by the relationship:

$$s=k_P\cdot\sqrt{t}$$

where s: thickness of the secondary scale layer $k_P$: scale coefficient t: oxidation time from the completion of descaling.

12. The method according to claim 8, wherein the distance between the last upper row of nozzles in the conveying direction and the last lower row of nozzles in the conveying direction is selected to be at least 0.2 m.

13. The method according to claim 1, wherein the distance between the last upper row of nozzles in the conveying direction and the last lower row of nozzles in the conveying direction is selected to be at least 0.2 m.

14. The method according to claim 1, wherein the distance between the last row of nozzles in the conveying direction and the at least one roll stand, in particular the first roll stand, is at most 6.0 m.

15. The method according to claim 1, wherein the specified value for the difference between the thickness ($s_{upper}$) of the secondary scale layer on the upper side of the metal article and the thickness ($s_{lower}$) of the secondary scale layer on the lower side of the metal article when entering the first roll stand is determined according to the relationship:

$$|(s_{upper}-s_{lower})|/s_{mean}*100\%\leq 15\%$$

where: $s_{mean}=(s_{upper}+s_{lower})/2$.

16. The method according to claim 1, wherein a temperature of the metal article in a region between the scale washer and the first roll stand is set so that for the temperature of the metal article on the upper side and for the temperature ($T_{lower}$) of the metal article on the lower side when entering the first roll stand, the following applies:

$$|(T_{upper}-T_{lower})|/T_{mean}*100\%\leq 3\%$$

where: $T_{mean}=(T_{upper}+T_{lower})/2$ (temperatures in ° C.).

17. The method according to claim 1, wherein the metal article is additionally cooled using water in a region between the scale washer and the first roll stand.

18. The method according to claim 1, wherein different nozzle sizes are used in the scale washer on the upper side of the metal article and on the lower side of the metal article.

19. The method according to claim 1, wherein a further row of nozzles is provided for the lower side of the metal article in the scale washer, which is activated when necessary.

20. The method according to claim 1, wherein an amount of water and/or a pressure level of discharged water in at least one of the rows of nozzles on the upper side and/or on the lower side of the metal article is set individually depending on a feed speed of the metal article into the rolling mill and/or a material composition of the metal article.

* * * * *